United States Patent [19]

Tempelman

[11] Patent Number: 5,005,738

[45] Date of Patent: Apr. 9, 1991

[54] AEROSOL VALVE DEVICE

[75] Inventor: Antonie P. Tempelman, Meeden, Netherlands

[73] Assignee: Mobacc B. V., Veendam, Netherlands

[21] Appl. No.: 328,568

[22] Filed: Mar. 27, 1989

[30] Foreign Application Priority Data

Mar. 28, 1988 [NL] Netherlands ..... 8800774

[51] Int. Cl.[5] ..... B65D 83/14

[52] U.S. Cl. ..... 222/402.19; 137/38; 251/65

[58] Field of Search ..... 222/402–419; 251/65; 137/38, 43

[56] References Cited

U.S. PATENT DOCUMENTS

| | | | |
|---|---|---|---|
| 2,629,401 | 2/1953 | Miller | 137/657 |
| 2,793,794 | 5/1957 | Samuel | 222/402.19 |
| 2,904,229 | 9/1959 | Samuel | 222/402.19 |
| 2,968,428 | 1/1961 | Samuel | 222/394 |
| 3,018,023 | 1/1962 | Talarico | 222/402.19 |
| 3,212,751 | 10/1965 | Hassa | 251/65 |
| 3,447,551 | 6/1969 | Braun | 222/402.19 |
| 3,733,013 | 5/1973 | Doyle | 222/402.19 |
| 3,893,596 | 7/1975 | Beres et al. | 222/402.19 |
| 3,983,890 | 10/1976 | Rogers | 137/38 |
| 4,261,485 | 4/1981 | Berg | 251/65 |
| 4,300,489 | 11/1981 | Perrin | 251/65 |
| 4,572,406 | 2/1986 | Pratt et al. | 222/402.19 |
| 4,662,271 | 5/1987 | Woltermann | 251/65 |
| 4,723,692 | 2/1988 | Meuresch | 222/402.19 |

FOREIGN PATENT DOCUMENTS

| | | |
|---|---|---|
| 0043514 | 6/1981 | European Pat. Off. . |
| 2551828 | 3/1985 | France . |

*Primary Examiner*—Robert P. Olszewski
*Assistant Examiner*—Steven Reiss
*Attorney, Agent, or Firm*—Weingarten, Schurgin, Gagnebin & Hayes

[57] ABSTRACT

An aerosol valve device for use with spray canisters using compressed gas as a propellant. The valve device comprises an aerosol valve and a connector for a riser tube which, in the operative condition, extends nearly to the bottom of an aerosol container. A two-way valve is provided between the aerosol valve and the connector. The two-way valve comprises a body with a central bore, in which two opposed valve seats are formed to seat a valve member movable to and fro between said valve seats, and an automatic actuating element for actuating said valve member control the valve member depending on the position of the container. The valve member cooperates with one valve seat to clear a connection between the riser tube and the aerosol valve and simultaneously to block a connection between the direct surroundings of the two-way valve and the aerosol valve, and cooperates with the other valve seat to block the connection between the reiser tube and the aerosol valve and at the same time to clear a connection between the direct surroundings of the two-way valve and the aerosol valve.

13 Claims, 2 Drawing Sheets

AEROSOL VALVE DEVICE

This invention relates to an aerosol valve device, suitable in particular for use with spray canisters or other containers from which liquid can be forced out in the form of a fine mist, using compressed gas as a propellant.

In the past, the propellants used in aerosol containers were often based on chlorofluorohydrocarbons. These known propellant gases, however, have fallen into disrepute, and there has been a search for propellants which are more friendly to the environment. It has already been proposed to use harmless and in addition cheap gases, such as compressed air or compressed nitrogen, as propellants in aerosol containers. A problem in using such environmentally friendly propellants, but also in using other compressed propellants (as contrasted with liquified propellant gases) is that only a limited quantity of compressed propellant can be stored in a spray canister. If propellant gas is lost during the use of an aerosol container of the type using compressed gas as a propellant, the pressure within the container is decreased. In particular when the aerosol is operated when tilted to a horizontal or further position, or even upside down, there is a large risk that propellant is lost. As a result, the contents of such an aerosol container can often not be used in an optimum manner.

There is accordingly a need for an aerosol container arranged so that the propellant is unable to leave the container, at least without entraining the product to be sprayed in the usual manner, in particular, when the container is operated in a position different from the vertical position with the aerosol valve up.

It is an object of the present invention to satisfy the need outlined above.

According to the present invention, there is provided an aerosol valve device, comprising an aerosol valve and a connector for a riser tube which, in the operative condition, extends nearly to the bottom of an aerosol container, characterized by a two-way valve provided between the aerosol valve and the connector, said two-way valve comprising a body with a central bore, in which two opposed valve seats are formed to seat a valve member movable to and fro between said valve seats; automatic actuating means for actuating said valve member, which control the valve member depending on the position of the container; said valve member cooperating with one valve seat to clear a connection between the riser tube and the aerosol valve and simultaneously to block a connection between the direct surroundings of the two-way valve and the aerosol valve, and said valve member cooperating with the other valve seat to block the connection between the riser tube and the aerosol valve and at the same time to clear a connection between the direct surroundings of the two-way valve and the aerosol valve.

Some embodiments of the invention will now be described, by way of example, with reference to the accompanying drawings.

FIG. 1 diagrammatically shows one example of a portion of an aerosol container in the normal position for use, and equipped with a valve device according to the present invention;

Figure 1:
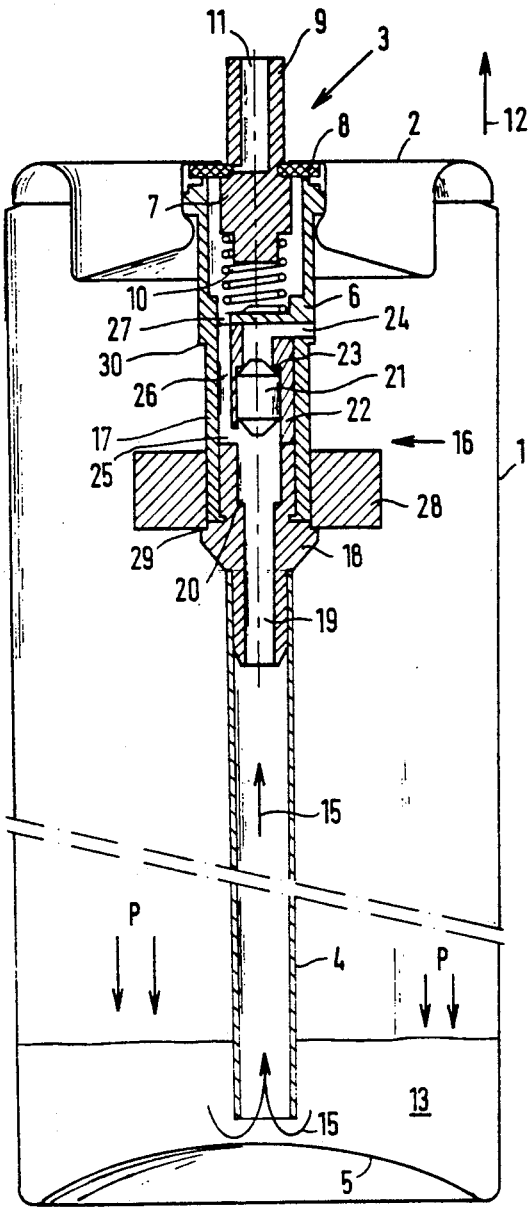

FIG. 1 diagrammatically shows an example of an aerosol valve device according to the present invention.

The aerosol shown comprises a conventional container 1 with a valve dish 2, an aerosol valve 3, and a riser tube 4, connected to the aerosol valve, and extending nearly to the bottom 5 of the container. The aerosol valve comprises, in the conventional manner, a valve body 6 which forms a chamber in which a valve member 7 is contained, which is biased by a spring 10 into contact with a sealing ring 8, and comprises a valve tube 9 with a bore 11, projecting beyond the container and the sealing ring. The valve tube 9 is often further provided with an operating button, with which the tube with the valve member can be depressed against the action of spring 10. As a result the bore 11 is connected with the chamber of the valve body. The chamber is in turn in connection with riser tube 4, so that the product contained in the container can leave it through the riser tube and the valve when the valve tube is depressed.

FIG. 1 shows the aerosol container in the normal position, i.e., bottom down and the aerosol valve up, as symbolized with an arrow 12.

In that position, the product 13 to be sprayed, as shown, is contained in the bottom part of the canister, while the compressed propellant gas is contained on top of product 13, on which it exercises a propellant pressure P. As soon as the aerosol valve is operated, the propellant gas propels the product 13 through riser tube 4 to aerosol valve 3, as indicated by arrows 15. In this way the product can leave the canister, but the propellant can not, because there is a liquid seal between the access opening of the riser tube and the propellant gas, formed by the product.

Figure 2:
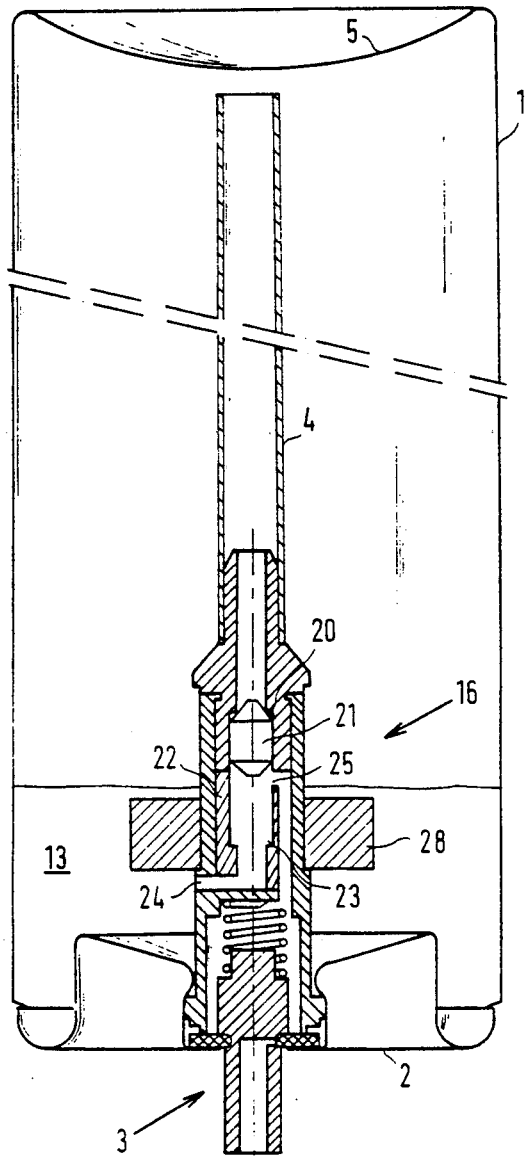
FIG. 2 shows the aerosol container of FIG. 1 in upside down position.

If, however, the container described is tilted, or even kept upside down, as shown in FIG. 2, and operated in that position, the liquid sealing the access to the riser tube is absent. The product 13 is then in the original top part of the container and fully clears the access to the riser tube. When the aerosol valve is depressed, the propellant can leave the container without hindrance. This latter is highly undesirable, as it decreases the pressure within the container, which can become even so low as to render the aerosol container unfit for further use, although a sufficient amount of product is still contained in it.

According to the present invention, the undesirable effect described above is remedied by using a special valve 16, one example of which is shown diagrammatically in FIGS. 1 and 2.

Valve 16 is provided between the end of the riser tube 4 remote from bottom 5 and the aerosol valve and in fact forms a two-way valve, which connects either the riser tube or a duct to be described hereinafter with the aerosol valve.

In the embodiment shown, the valve 16 comprises a body 17 which is coextensive with the riser tube and in this example is formed integrally with valve body 6. Body 17 is provided at the bottom with a connector 18, with which the riser tube is connected. Connector 18 has a central bore 19 which is a continuation of the riser tube channel and is widened at the end of connector 18 extending into body 17 to form a first valve seat 20 to seat a valve member 21. Connector 18 connects to an insert 22 provided in body 17 and also having a central bore which is a continuation of the widened bore in the connector and at a point spaced from the connector is narrowed to form a second valve seat 23 for the valve member.

Beyond the second valve seat, the narrowed bore connects with a cross bore 24 which forms a connection with the interior of the container. The insert is provided in the end face facing connector 18 with a recess 25 forming a connection with a second recess 26 provided in the insert in the longitudinal direction, which second recess 26 connects through a through bore 27 in the bottom of the chamber of valve member 6 with the chamber of the valve member.

The distance between the two valve seats 20, 23 and the recess 25 located between the valve seats is so large that the valve member leaves clear recess 25 both in the bottom position, i.e., the position in which the valve member is within connector 18, and in the topmost position, as shown in FIG. 1.

In the topmost position shown in FIG. 1, the valve member leaves clear the connection between the central bore 19 and recess 25, while at the same time the connection between cross bore 24 and recess 25 is blocked. Accordingly, the propellant gas situated in the top part of the container cannot escape through recess 25, the second recess 26 and valve 3 when the aerosol is operated. In that case, however, the product 13 is forced to the outside by the propellant gas in the manner described before, through riser tube 4, bore 19, recesses 25 and 26 and valve 3.

As, in the uppermost position shown in FIG. 1, which is necessary for normal operation, the valve member 21 is subjected to both gravity and the propellant gas pressure, through bore 24, so that valve member 21 tends to move downwardly, measures have been taken to ensure that the valve member remains indeed pressed against the top valve seat 23 in the normal position of the aerosol canister.

In the embodiment shown, to this effect, an annular permanent magnet 28 is provided around body 17, which can move freely up and down over a cylindrical portion of body 17 located between two shoulders 29 and 30. Furthermore, valve member 21, too, is formed as a permanent magnet, with the annular magnet and the magnetic valve member being of opposite polarities. In the embodiment shown, the bottom side of the annular magnet, facing bottom 5, for example, may form a magnetic south pole, and so can the top side of the valve member facing the valve chamber. The top side of the annular magnet and the bottom side of the valve member then form the magnetic north poles.

In the normal position of the aerosol container, the annular magnet rests through gravity on the bottom shoulder 29, which in this example is formed by an edge of connector 18 extending beyond body 17. The valve member is then kept in the top position shown through the repellent action between similar magnetic poles.

When the aerosol container is held upside down, as shown in FIG. 2, the annular magnet slides, through gravity, to the shoulder 30, which is then the bottom one. The valve member is then repelled by the magnetic fields prevailing and comes to lie in contact with the valve seat 20, which is then the top seat. In that situation, the product 13 is also contained in the part of the container which is normally the top part. In addition, in that situation, recess 25 is connected through the central bore in the insert 22 and the cross bore 24 with the interior of the container, so that the product can again reach the recess 26 and thence the aerosol valve. The propellant cannot reach recess 25, as the cross bore is sealed by the product, while a passageway through the riser tube 4 is closed by the valve member.

By using two repellent magnets, a very clear switching action is realized, with the valve member being pressed either against one valve seat or against the other, and with intermediate positions and/or sticking being substantially avoided.

A further important point is that, in both positions of the valve member, a possible direct passageway for the propellant gas is positively sealed.

It is noted that, after reading the foregoing, various modifications will readily occur to those skilled in the art.

Thus, the annular magnet 28 need not be magnetic throughout its entire volume, but a carrier, fittingly provided about body 17 and comprising one or more radially symmetrically arranged permanent magnets could be all that is needed.

Alternatively, the contemplated reciprocation of the valve member 21 could be brought about mechanically. Instead of an annular magnet 28, a given weight, which can slide to and fro through a certain distance, can be used. This weight should then be coupled to the valve member through a lever system. One example is shown diagrammatically in FIG. 3.

Figure 3:
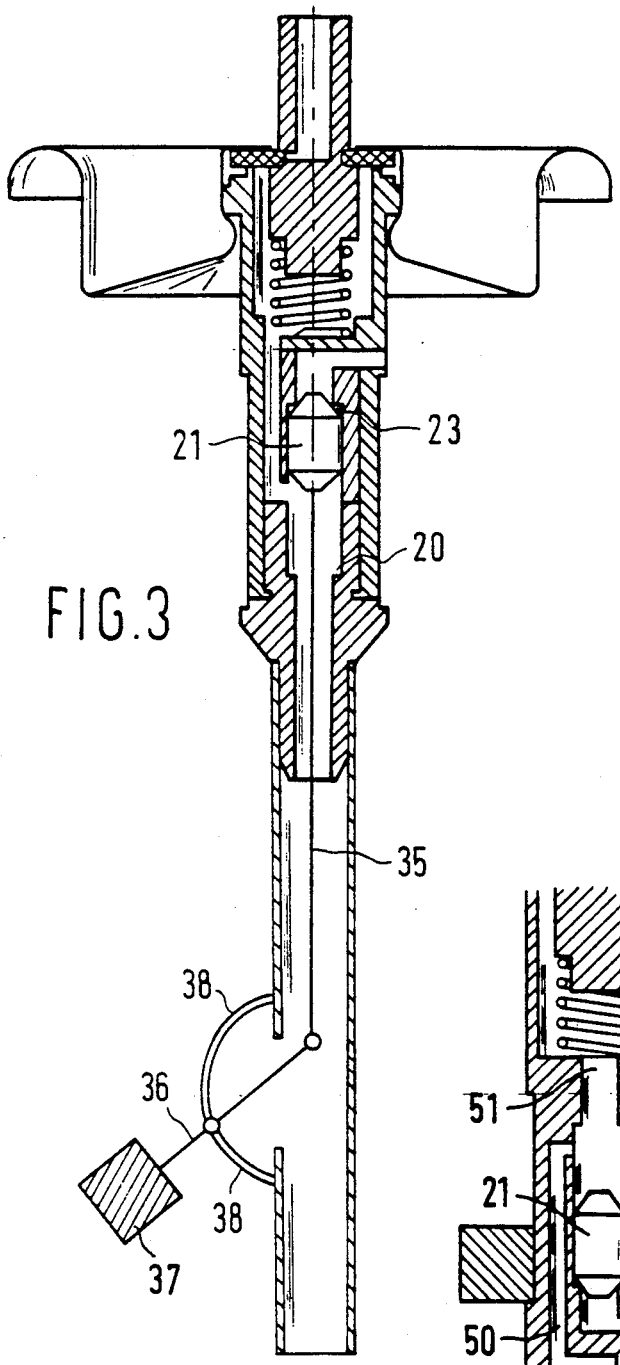
FIGS. 3-5 show some other embodiments of the present invention.

As shown in FIG. 3, a non-magnetic valve member 21 is connected through a thin rod 35, extending through riser tube 4, to one end of a lever 36, which at the other end carries a weight 37.

The lever 36 can extend through an aperture in the wall of the riser tube, as shown, or be provided at the bottom end of the riser tube. In the example shown, the fulcrum of the lever is spaced some distance from the riser tube to increase the stroke of the end extending into the riser tube.

When a shorter valve member is used, however, valve seats 20 and 23 may be more closely spaced, and in that case the lever fulcrum may be at the level of the wall of the riser tube. Separate supports 38 for journalling the lever are then unnecessary.

Figure 4:
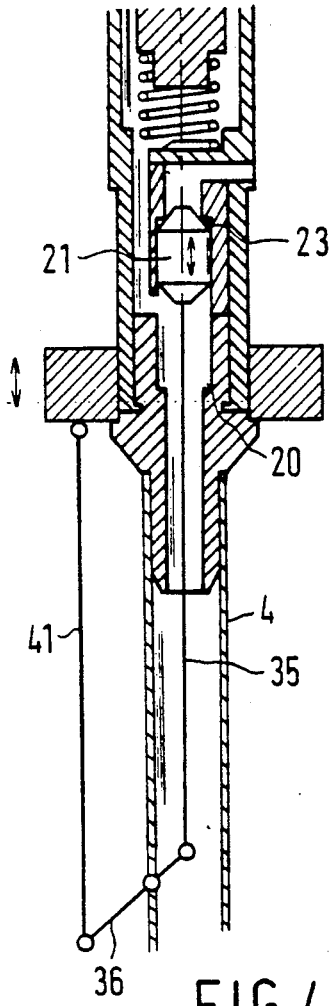

Weight 37 may be formed in various ways. Thus, for example, weight 37 may be a weight which is slidable up and down about the riser tube. Also, weight 37 could be placed, similarly to the annular magnet, around body 27 and be connected to the lever through a rod extending downwardly. The principle is shown diagrammatically in FIG. 4. A weight 40, which is movable up and down, is connected through a rod 41 to the free end of lever 36. Lever 36 is, in turn, connected within the riser tube through a rod 35 to the valve member.

It is noted that, in the examples shown, lever 36 is disposed in the vicinity of, or at, the free end of the riser tube, so that the aperture in the side wall of the riser tube, through which the lever is passed, need not be sealed gas-tight.

If, however, a gas-tight passage of the lever is used, the lever may alternatively be closer to the valve member.

According to another modification, a magnet 28 can be used in conjunction with a valve member 21 which is not permanently magnetic, but magnetizable. The valve member is then attracted by the magnet, so that the various ducts in the valve bodY should be modified to match the situation.

Figure 5:
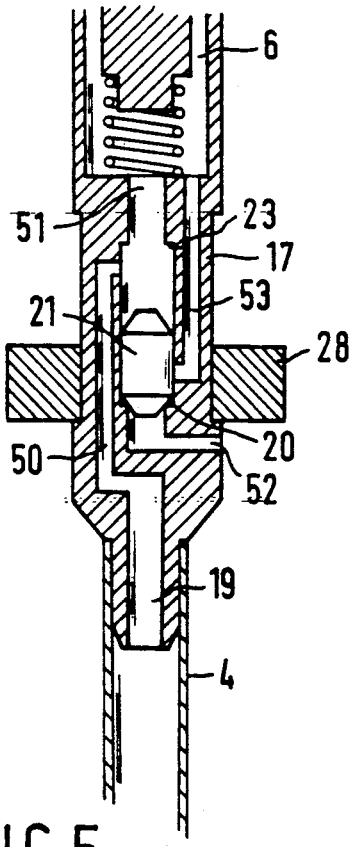

One example of such an embodiment is shown diagrammatically in FIG. 5. Here again, a magnet 28 is disposed for up and down movement about valve body 17, and in this case cooperates with a valve member 21, made of steel, for example. When the aerosol container is kept in the upright position, the magnet and the valve member are in the lowermost position shown, in which valve member 21 rests on valve seat 20. The product contained in the container can now be forced to the outside through riser tube 4, a blind central bore 19' in a duct 50 by-passing the valve member, the upper valve seat 23 and a passageway 51 connected to it to the chamber in the valve body 6.

The bottom valve seat connects with a cross duct 52, but propellant gas penetrating into the cross duct 52 is, in the position shown, blocked by the valve member.

When the aerosol container is turned upside down, the magnet 28 is shifted, thereby taking along the valve member until it lies in contact with the valve seat 23, which is in the uppermost position in FIG. 5.

Duct 50 is then closed, and the product can again reach the chamber in the valve body 6 through the cross duct 52 and a duct 53, which is then cleared by the valve member 21.

It is further observed that an additional advantage of the use of an aerosol valve device according to the present invention is that a canister provided with such a valve device permits the use of compositions unsuitable for use with known aerosol containers. Possible uses contemplated are aqueous products.

I claim:

1. An aerosol valve device, suitable in particular for use with spray canisters or other containers from which liquid can be forced out in the form of a fine mist, using compressed gas as a propellent, said valve device comprising:

an aerosol valve;

a connector;

a riser tube connected to the connector;

a two-way valve provided between the aerosol valve and the connector, said two-way valve comprising a body with a central bore, in which two opposed valve seats are formed to seat an elongated valve member moveable between said valve seats;

automatic actuating means for actuating said valve member, which control the valve member depending on the position of the container;

said valve member cooperating with one valve seat to clear a connection between the riser tube and the aerosol valve and simultaneously to block a connection between the direct surroundings of the two-way valve and the aerosol valve, and said valve member cooperating with the other valve seat to block the connection between the riser tube and aerosol valve and at the same time to clear a connection between the direct surroundings of the two-way valve and the aerosol valve;

said valve member being made of magnetizable material and said automatic actuating means comprise a member disposed about the body of the two-way valve, which actuating means is at least partly permanently magnetic and can move freely along the body through a path corresponding to the patch between the two valve seats.

2. A valve device as claimed in claim 1, characterized in that the valve member is a permanent magnet poled so that the valve member and said at least partly permanently magnetic member repel one another.

3. A valve device as claimed in claim 2, characterized in that the body of the two-way valve is a tubular body co-extensive with the valve body, and into which, at the end remote from the valve body, the connector for the riser tube has been inserted, which connects to an insert inserted into the body, with one valve seat being formed in the insert, and the other valve seat in the connector.

4. A valve device as claimed in claim 3, characterized in that the insert and the connector jointly define a central bore extending between, and beyond, the valve seats, and connecting to the riser tube, the central bore being connected beyond the valve seat located closest to the valve body through a cross bore to the surroundings of the body, the insert forming a cross-duct located between the two valve seats, which cross-duct is connected to a duct extending parallel to the central bore and connected to the valve body.

5. A valve device as claimed in claim 2, characterized in that the permanently at least partly magnetic member is an annular magnet fittingly enclosing the body and capable of moving along the housing between two spaced stops.

6. A valve device as claimed in claim 5, characterized in that the body of the two-way valve is a tubular body co-extensive with the valve body, and into which, at the end remote from the valve body, the connector or the riser tube has been inserted, which connects to an insert inserted into the body, with one valve seat being formed in the insert, and the other valve seat in the connector.

7. A valve device as claimed in claim 1, characterized in that the valve member is connected to a thin rod extending within the riser tube nearly to the free end thereof, which rod is connected at its end remote from the valve member to one end of a lever, the other end of said lever cooperating with a weight.

8. A valve device as claimed in claim 7, characterized in that the weight is a weight which is movable along the riser tube or the valve body.

9. A valve device as claimed in claim 8, characterized in that the body of the two-way valve is a tubular body co-extensive with the valve body, and into which, at the end remote from the valve body, the connector or the riser tube has been inserted, which connects to an insert inserted into the body, with one valve seat being formed in the insert, and the other valve seat in the connector.

10. A valve device as claimed in claim 7, characterized in that the body of the two-way valve is a tubular body co-extensive with the valve body, and into which, at the end remote from the valve body, the connector or the riser tube has been inserted, which connects to an insert inserted into the body, with one valve seat being formed in the insert, and the other valve seat in the connector.

11. A valve device as claimed in claim 1, characterized in that the permanently at least partly magnetic member is an annular magnet fittingly enclosing the body and capable of moving along the housing between two spaced stops.

12. A valve device as claimed in claim 11, characterized in that the body of the two-way valve is a tubular body co-extensive with the valve body, and into which, at the end remote from the valve body, the connector or the riser tube has been inserted, which connects to an insert inserted into the body, with one valve seat being formed in the insert, and the other valve seat in the connector.

13. An aerosol container in combination with an aerosol valve device as claimed in claims 1, 2, 11, 7, 8, 3, 4, 5, 12, 10, 9 or 6.

* * * * *

UNITED STATES PATENT AND TRADEMARK OFFICE

CERTIFICATE OF CORRECTION

PATENT NO. : 5,005,738

DATED : April 9, 1991

INVENTOR(S) : Antonie P. Tempelman

It is certified that error appears in the above-identified patent and that said Letters Patent is hereby corrected as shown below:

Column 1, line 19, "liquified" should read --liquefied--.

Column 4, line 61, "bodY" should read --body--.

Column 6, line 15, "in that the permanently at least partly" should read --in that the at least partly permanently--.

Column 6, line 51, "in that the permanently at least partly" should read --in that the at least partly permanently--.

Signed and Sealed this

Eighteenth Day of January, 1994

Bruce Lehman

*Attest:*

BRUCE LEHMAN

*Attesting Officer*

*Commissioner of Patents and Trademarks*